US007589626B2

(12) United States Patent
Hane

(10) Patent No.: US 7,589,626 B2
(45) Date of Patent: Sep. 15, 2009

(54) SECURITY SYSTEM AND METHOD

(75) Inventor: John Hane, Bethesda, MD (US)

(73) Assignee: Xanadoo Company, Bala Cynwyd, PA (US)

( * ) Notice: Subject to any disclaimer, the term of this patent is extended or adjusted under 35 U.S.C. 154(b) by 0 days.

(21) Appl. No.: 10/667,330

(22) Filed: Sep. 23, 2003

(65) Prior Publication Data

US 2004/0135685 A1 Jul. 15, 2004

Related U.S. Application Data

(60) Provisional application No. 60/412,584, filed on Sep. 23, 2002.

(51) Int. Cl.
*G08B 1/08* (2006.01)

(52) U.S. Cl. ..... 340/539.1; 340/541; 340/539.14; 455/3.01; 455/3.02; 455/427; 455/11.1; 348/152

(58) Field of Classification Search ..... 340/541, 340/539.14, 539.16, 539.18, 539.1; 455/3.01, 455/3.02, 3.06, 11.1, 427; 348/152–155
See application file for complete search history.

(56) References Cited

U.S. PATENT DOCUMENTS 3,833,895 A * 9/1974 Fecteau ..... 340/505
5,543,778 A 8/1996 Stouffer
5,559,496 A * 9/1996 Dubats ..... 340/539.26
5,594,740 A 1/1997 LaDue
5,689,235 A 11/1997 Sugimoto et al.
5,708,963 A * 1/1998 Mobley et al. ..... 455/12.1
5,887,243 A 3/1999 Harvey et al.
5,907,279 A 5/1999 Bruins et al.
6,134,303 A 10/2000 Chen
6,144,859 A 11/2000 LaDue
6,144,998 A * 11/2000 Pisterzi ..... 725/109
6,392,538 B1 * 5/2002 Shere ..... 340/539.26
6,504,479 B1 * 1/2003 Lemons et al. ..... 340/541
6,577,234 B1 * 6/2003 Dohrmann ..... 340/540
6,614,884 B2 * 9/2003 Jang ..... 379/41
6,643,510 B2 * 11/2003 Taylor ..... 455/431
6,658,463 B1 * 12/2003 Dillon et al. ..... 709/219
6,661,340 B1 * 12/2003 Saylor et al. ..... 340/517
6,696,942 B2 * 2/2004 Sweatt ..... 340/539.1
6,727,811 B1 * 4/2004 Fendis ..... 340/506
6,756,896 B2 * 6/2004 Ford ..... 340/506
6,764,261 B1 * 7/2004 Stadler ..... 411/342

* cited by examiner

*Primary Examiner*—Toan N Pham
*Assistant Examiner*—Travis R Hunnings
(74) *Attorney, Agent, or Firm*—Hunton & Williams, LLP

(57) ABSTRACT

The present invention is directed to monitoring a predetermined area to protect against intrusion by trespassers and the like. An embodiment of the present invention is directed to a security system that provides detecting the presence of an intruder in a predetermined area or a plurality of predetermined areas; and communicating via satellite signals to a processing center the detection of the presence of the intruder in the predetermined area or in one or more of the plurality of predetermined areas; wherein the satellite signals encode data alerting the processing center to the presence of said intruder in said predetermined area or said one or more of the plurality of predetermined areas.

36 Claims, 4 Drawing Sheets

SECURITY SYSTEM AND METHOD

CLAIM TO BENEFIT OF PROVISIONAL APPLICATION

This application claims the benefit of U.S. Provisional Application No. 60/412,584 filed Sep. 23, 2002.

FIELD OF THE INVENTION

The present invention relates to a system, as well as an apparatus and a method, for detecting the presence of an intruder in a predetermined area and communicating the intruder's presence to a processing center via satellite signals.

BACKGROUND OF THE INVENTION

Security systems are normally deployed in homes and in other areas to prevent theft, damage, and injury to residents within the homes. More particularly, these systems include various alarm components or elements which are physically connected (e.g. by wire) to a central console. These elements generate an electrical signal upon the occurrence of an event such as the opening of a door or window or the presence of pressure upon a window or other portion of the house. Upon receipt of these signals, the central console typically activates a siren to "warn away" potential intruders and further communicates an alarm signal to a central monitoring station, effective to allow the central monitoring station to notify the police or other local authorities of the presence of an "alarm condition."

Traditionally detector apparatuses, such as burglar detectors, transmit an alarm message to a central apparatus of the security system via a wired connection when the detector apparatus detects an alarm condition. When the central apparatus receives an alarm message it uses alarm means, such as a siren or a light, to raise an alarm. Also, a silent alarm may be raised, for instance by triggering a remote security company or the police. Such systems are typically installed and maintained by professional companies. Similar systems of reduced complexity are available for domestic use and can be installed and maintained by a technically skilled consumer.

The conventional home security system typically needs wiring connection to electrically connect a number of indicating lights, buzzers, emergency buttons, and common power source connection at every house end. In the case that an emergency happens to any in the common system (for example, including 8-16 house ends), the application at one emergency button will trigger all buzzers and indicating lights in the system for successfully broadcasting the emergency situation and sending out the emergency signal.

However, the construction of the common power source, relative electricity devices, and the electrical wiring network is easily damaged, and thus is apt to induce a fault triggering which will disturb all customers in the system, raise unexpected anxiety, and even cause the whole system to shut down.

In considering the electric utilities safety, the conventional wiring system is usually restricted by the existing construction. For example, difficult work such as digging or breaking the wall is always possible in constructing the wiring. Also, the geometrical characteristics in the neighborhood enhance the possibility of exposing the wiring to the atmosphere while the wiring passes across the street and in which will increase the maintenance problem as well.

With the continuing drop in cost and power requirements of electronic components and the liberalization of the use of certain RF transmission bands, cost-effective cordless system have become available which can be installed and maintained by the general public. Such a system is known from the Home Security System, 1995 of Grundig, for example. Each detector apparatus is locally powered, for instance, by a battery. The detector apparatus transmits a message via RF to the central apparatus, upon detecting an alarm condition, making the system fully cordless. Unlike wired systems, the communication is, in principle, not restrained to the principal area to be protected by the system. Typically, the communication range is 30 meters, allowing the system to cover an area with a diameter of approximately 60 meters, with the central apparatus at the center. In many domestic situations this implies that (parts of) neighboring houses or apartments are included in this communication area, whereas, in general, the area to be protected is limited to a smaller area, such as one house or one apartment. To ensure that the central apparatus only responds to alarm messages transmitted by detectors, which are intended to be guarded and, for instance, not by detectors which are part of a neighboring security system, a alarm message is only accepted if it is transmitted by a detector which is known to the central apparatus. Each apparatus has a unique communication address.

Whenever a detector apparatus transmits an alarm message, the unique address is included in the alarm message as the source address of the message. Before an alarm message is accepted from a specific detector apparatus, the detector apparatus needs to be trained to the central apparatus. During the training, first the central apparatus is brought into a learning mode, by using a key to bring the central apparatus into the installation mode and pressing a button on the central apparatus to bring the central apparatus to a learning mode. Next, an alarm is triggered on the detector apparatus, which needs to be learned. Typically, a tamper alarm is triggered. Upon receiving the resulting alarm message, the central apparatus stores the source address of the received alarm message in a memory. The user can select the memory location in which a specific detector is stored. Using buttons on the central apparatus, the user can selectively disable or enable memory locations. Alarm messages from a detector apparatus, whose memory location has been disabled, are not acted upon by the central apparatus. In this ways, zones of a house, each covered by a detector apparatus, can selectively be guarded or not guarded. It is desired that the chance is reduced of an apparatus being trained, which should not be part of the system. In order to avoid that a neighboring detector apparatus, which transmits an alarm message at the moment of the central apparatus being in the learning mode, is stored in the central apparatus, the Home Security System of Grundig requires a detector apparatus to be near the central apparatus for the detector apparatus to be accepted. Since the normal operational distance is larger, this requires the central apparatus to use different thresholds for receiving messages.

Furthermore, limiting the operational distance provides no adequate protection in certain situations of, for instance terraced houses or apartments, where typically entrances are located immediately next to one another and central apparatuses and some detector apparatuses tend to be located in the entrance halls. Moreover, this requires detector apparatuses to be near the central apparatus and not at the location/zone where the detector apparatus is intended to operate. This increases the chance of the user, mistakenly, placing a detector apparatus in a different zone than programmed on the central apparatus. Since the alarm raised by the central apparatus, in the Grundig system, is specific for a memory location (and therefore for a zone), this may have a significant impact.

Various approaches have been attempted for improving security systems. For example, U.S. Pat. No. 5,543,778 discloses a home security system that includes a plurality of alarm elements; a central console including a microprocessor in wireless communication with the alarm elements and effective to receive a signal from the alarm elements; an automobile including an alarm system in wireless communication with the central console's microprocessor and effective to activate certain alarm elements when the automobile's alarm system is in close proximity to the home security system and when the automobile is started; the microprocessor being connected to a tri-state analog to digital converter which includes a plurality of resistors whose resistance values cooperatively determined an accuracy of analog to digital conversion with respect to the received signal transmitted from the alarm elements.

An EEPROM that includes gray scale conversion is also realized. U.S. Pat. No. 5,907,279 discloses a security system, detector apparatuses (101, 102, 103) transmit an alarm message to a central apparatus 100 via RF in response to detecting an alarm condition. The message comprises a source identification uniquely identifying the transmitting apparatus. The central apparatus 100 raises an alarm if the alarm message is sent by a detector apparatus, which is part of the system. To this end, the central apparatus 100 only processes an alarm message if the source identification of the alarm message is stored in a memory means 200 of the central apparatus. For a new detector apparatus to be accepted as part of the system, the identification of the detector apparatus needs to be stored in the memory means 200 of the central apparatus. To reduce the chance of identifications of neighboring apparatuses inadvertently being stored, a detector apparatus transmits a learn-detector message in response to a learn trigger, for instance from a user. The central apparatus 100 stores the source identification of a received learn-detector message only if the central apparatus 100 is in a learning mode.

U.S. Pat. No. 6,134,303 discloses a united home security system for joining a plurality of client-sides is disclosed. The system includes a sensing circuit, a subscriber emergency handling/communication circuit, a client-side monitor/control server, a remote administrating and monitoring device, and an alarm transmitting network. Each client-side communicates with the remote administrating and monitoring device via a public telecom-network, for transmitting the state information at the client-side. In case an emergency signal is detected at any client-side, the client-side monitor/control server communicates with the remote administrating and monitoring device via the telecom-network, and then an alarm signal is generated by the alarm transmitting network.

However, the foregoing references are deficient in terms of effectiveness and/or cost-efficiency. Accordingly, it would be desirable to provide an improved security system that is effective in providing security to a property, such as a home or workplace. Further, it would be desirable to provide a security system that remedies the deficiencies or prior systems and is cost-efficient.

SUMMARY OF THE INVENTION

The present invention provides an effective system for providing security to a property. Further, the present invention provides a security system that is both effective and cost-efficient.

An embodiment of the present invention provides a security system comprising: detecting means for detecting the presence of an intruder in a predetermined area or a plurality of predetermined areas; and communicating means for communicating via satellite signals to a processing center the detection of the presence of the intruder in the predetermined area or in one or more of the plurality of predetermined areas; wherein the satellite signals encode data alerting the processing center to the presence of said intruder in said predetermined area or said one or more of the plurality of predetermined areas.

A further embodiment of the present invention provides a security system comprising: detecting means at a subscriber location for detecting the presence of an intruder in a predetermined area or a plurality of predetermined areas; communicating means for communicating via satellite signals to a processing center the detection of the presence of the intruder in the predetermined area or in one or more of the plurality of predetermined areas; and processing means at the processing center for receiving and processing the satellite signals to produce a local response; wherein the satellite signals encode data alerting the processing center to the presence of said intruder in said predetermined area or in the one or more of the plurality of predetermined areas.

A still further embodiment of the present invention provides a security system comprising: communicating means for communicating via satellite signals to a processing center the detection of the presence of an intruder in a predetermined area or in a plurality of predetermined areas; and detecting interface means for operatively associating the communicating means with detecting means, said detecting means being able to detect the presence of an intruder in the predetermined area or in one or more of the plurality of predetermined areas; wherein the satellite signals encode data alerting the processing center to the presence of said intruder in said predetermined area or said one or more of the plurality of predetermined areas.

An even further embodiment provides a security system comprising: a subscriber antenna at a subscriber location for communicating via satellite signals to a processing center the detection of the presence of an intruder in a predetermined area or in a plurality of predetermined areas; and detection interface apparatus capable of operatively associating with means for detecting the presence of an intruder in the predetermined area or in one or more of the plurality of predetermined areas; wherein the satellite signals encode data alerting the processing center to the presence of said intruder in said predetermined area or in the one or more of the plurality of predetermined areas.

Another embodiment of the present invention provides a method of communicating the presence of an intruder in a predetermined area via satellite comprising: detecting the presence of an intruder in a predetermined area or a plurality of predetermined areas; and communicating via satellite signals to a processing center the detection of the presence of the intruder in the predetermined area or in one or more of the plurality of predetermined areas; wherein the satellite signals encode data alerting the processing center to the presence of said intruder in said predetermined area or said one or more of the plurality of predetermined areas.

Yet another embodiment of the present invention provides a method of communicating the presence of an intruder in a predetermined area via satellite comprising: detecting at a subscriber location the presence of an intruder in a predetermined area or a plurality of predetermined areas; communicating via satellite signals to a processing center the detection of the presence of the intruder in the predetermined area or in one or more of the plurality of predetermined areas; and receiving and processing at the processing center the satellite signals to produce a local response; wherein the satellite signals encode data alerting the processing center to the presence of said intruder in said predetermined area or in the one or more of the plurality of predetermined areas.

These and other objects, advantages, and features of the invention will be apparent from the following detailed description of the invention, considered along with the accompanying drawings.

DETAILED DESCRIPTION OF THE PREFERRED EMBODIMENTS

The present invention provides a system and method for monitoring a predetermined area to protect against intrusion by trespassers and the like. The system and method of the present invention utilize satellite signals to communicate the presence of an intruder in the predetermined area to a processing center to activate a response (e.g., dispatch police or security unit to property). The satellite-based security system optionally is a part of a multiple purpose satellite communications system. For example, the satellite communications system may provide broadband internet service, data. television, radio, and/or security communications, without limitation. Further, the satellite communications system may provide interactive or two-way communications, without limitation.

The use of satellites to transmit and receive radio signals is well known. Certain frequencies on the electromagnetic spectrum have been dedicated to satellite transmissions, by international agreement. In the case of direct broadcast satellite service ("DBS"), for example, the 1985 Regional Administrative Radio Conference (RARC) of the International Telecommunication Union established the spectrum for DBS at 17.3-17.8 GHz for the uplink and 12.2-12.7 GHz for the downlink in ITU Region 2, the Western Hemisphere. In all, thirty-two frequencies were allotted at each of eight orbital locations set aside for DBS in the United States. Significantly, the RARC also made provisions for the reuse of the satellite-allocated frequencies. See Mead, Donald C., *Direct Broadcast Satellite Communications*, pages 21-22 (2000).

FIGS. 1-4 illustrate four systems, each of which corresponds to four general categories of security systems, in accordance with various embodiments of the inventive subject matter, without intending to be limited thereto. A person of ordinary skill in the art would readily understand, based upon the disclosure herein, that there are numerous ways to implement and/or combine these general categories of the present invention.

Figure 1:
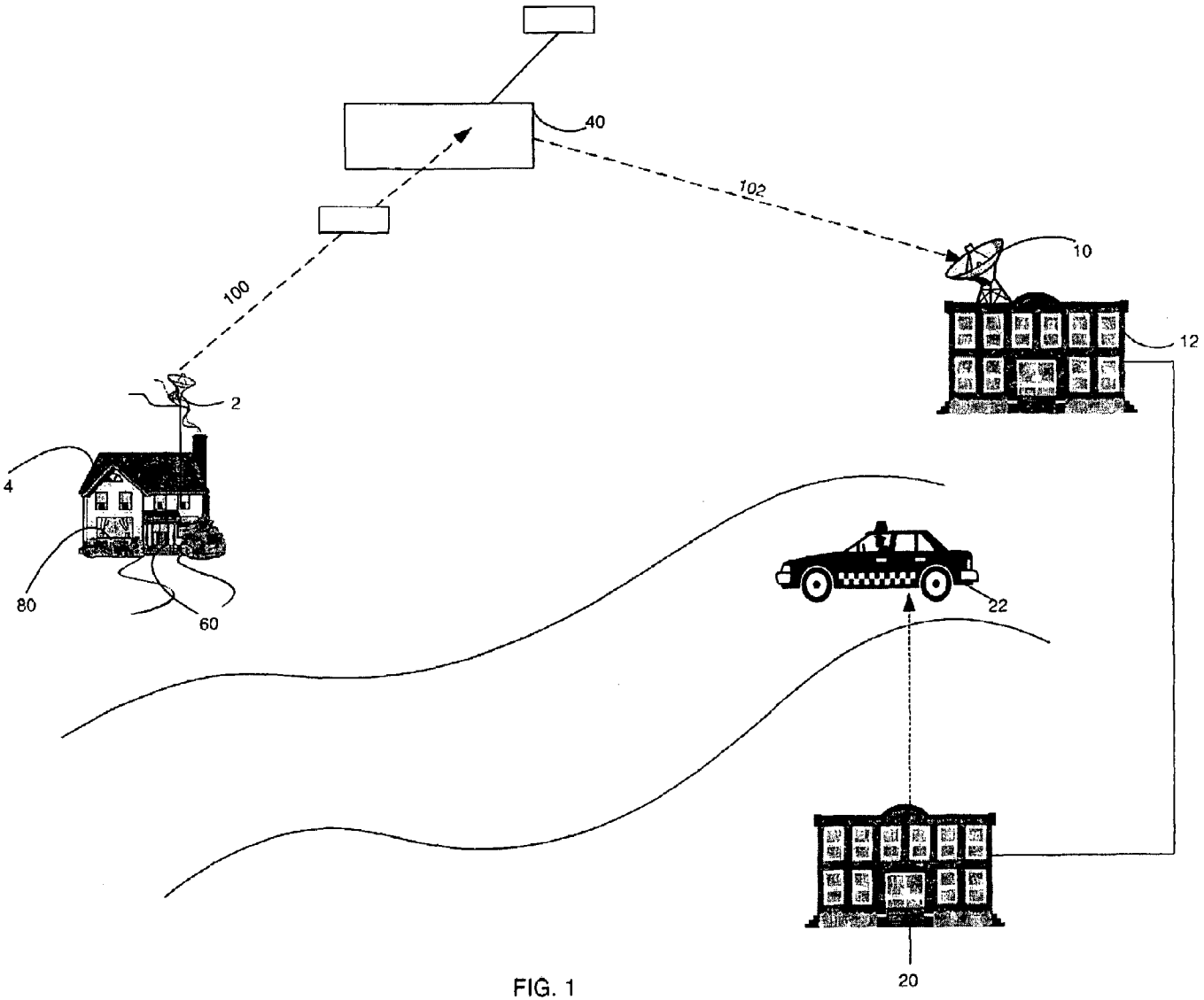
FIG. 1 is a schematic representation showing the positioning of a security system, satellite and processing center, according to an embodiment of the present invention.

A first system is illustrated in further detail in FIG. 1. As shown in FIG. 1, the system involves a subscriber antenna 2 for transmitting and/or receiving satellite signals. The subscriber antenna 2 is located at a subscriber location and supported by a support structure 4. According to an implementation of the present invention, when an intruder is detected within a predetermined area, as FIG. 1 shows, subscriber-to-provider return satellite uplink signals 100 are transmitted by the subscriber antenna 2 from the subscriber location in response to a predetermined event, such as detection of an intruder by detecting means 60, 80, to a satellite 40. A provider antenna 10 located at a provider location receives the subscriber-to-provider satellite downlink signals 102 that correspond to the satellite uplink signals 100.

Referring still to FIG. 1, the provider antenna 10 located at a provider location is operatively associated with a processing center 12. As shown in FIG. 1, when the intruder is detected in the predetermined area, the processing center 12 receives and processes the subscriber-to-provider satellite downlink signals 102 to produce an appropriate pre-designated response, such as notifying a local law enforcement agency to dispatch a patrol unit 22, for example, without limitation. The processing center 12 comprises a feed, a low-noise amplifier and block converter (LNB), where the signals are amplified and then directed to a processor for demodulation and other processing prior to being directed to an output device for review by a human monitoring said output device or an automated response system, or combination thereof.

Figure 2:
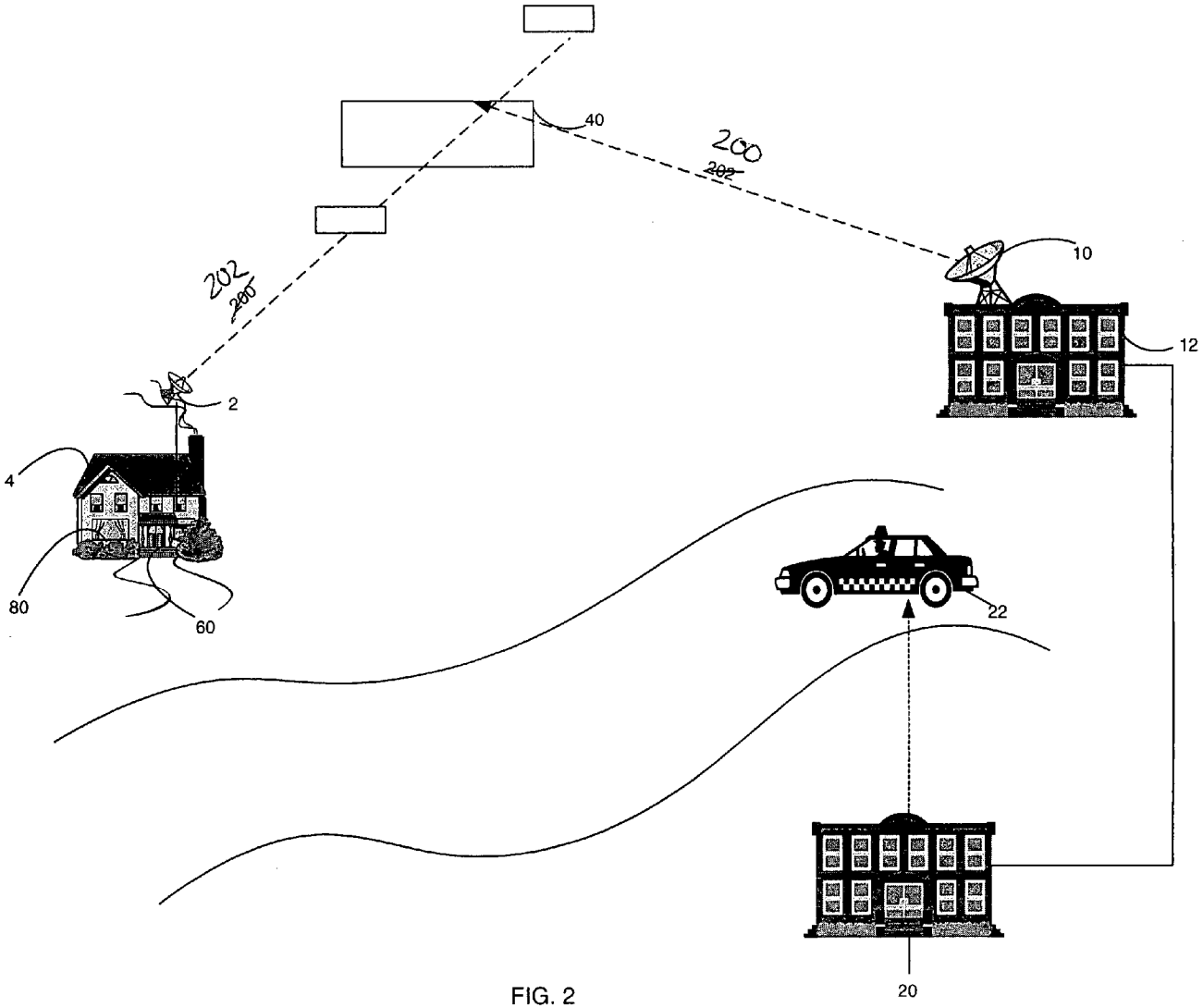
FIG. 2 is a schematic representation showing the positioning of a security system, satellite and processing center, according to an embodiment of the present invention.

A second system is illustrated in further detail in FIG. 2. As shown in FIG. 2, the system involves a subscriber antenna 2 for transmitting and/or receiving satellite signals. The subscriber antenna 2 is located at a subscriber location and supported by a support structure 4. According to an implementation of the present invention, provider-to-subscriber satellite uplink signals 200 are transmitted by the provider antenna 10 from the provider location to a satellite 40. A subscriber antenna 2 located at a subscriber location is positioned to receive the provider-to-subscriber satellite downlink signals 202. The provider-to-subscriber satellite signals carry data to activate an alarm/warning system at the subscriber location. As shown in FIG. 2, the provider antenna is transmitting a signal to activate a local response in the form of a patrol unit and a siren alarm at the subscriber location. This signal warns the subscriber location of an impending situation, such as a weather condition or natural or other disaster (e.g., flood, tornado, etc.), without limitation. In this manner, the present invention can operate as an early warning system.

Referring still to FIG. 2, the provider antenna 10 located at a provider location is operatively associated with the processing center 12. The processing center 12 receives information regarding a pre-designated condition and transmits the provider-to-subscriber satellite downlink signals 202 to produce an appropriate pre-designated response, such as notifying a local law enforcement agency 20 to dispatch a patrol unit 22 or activating a siren or producing an output, for example, without limitation. The subscriber antenna 2 is optionally operatively associated with a feed, a low-noise amplifier and block converter (LNB), where the signals are amplified and then directed to a processor for demodulation and other processing prior to being directed to an output device for review by a human monitoring or capable of receiving output from said output device or an automated response system, or combination thereof.

Figure 3:
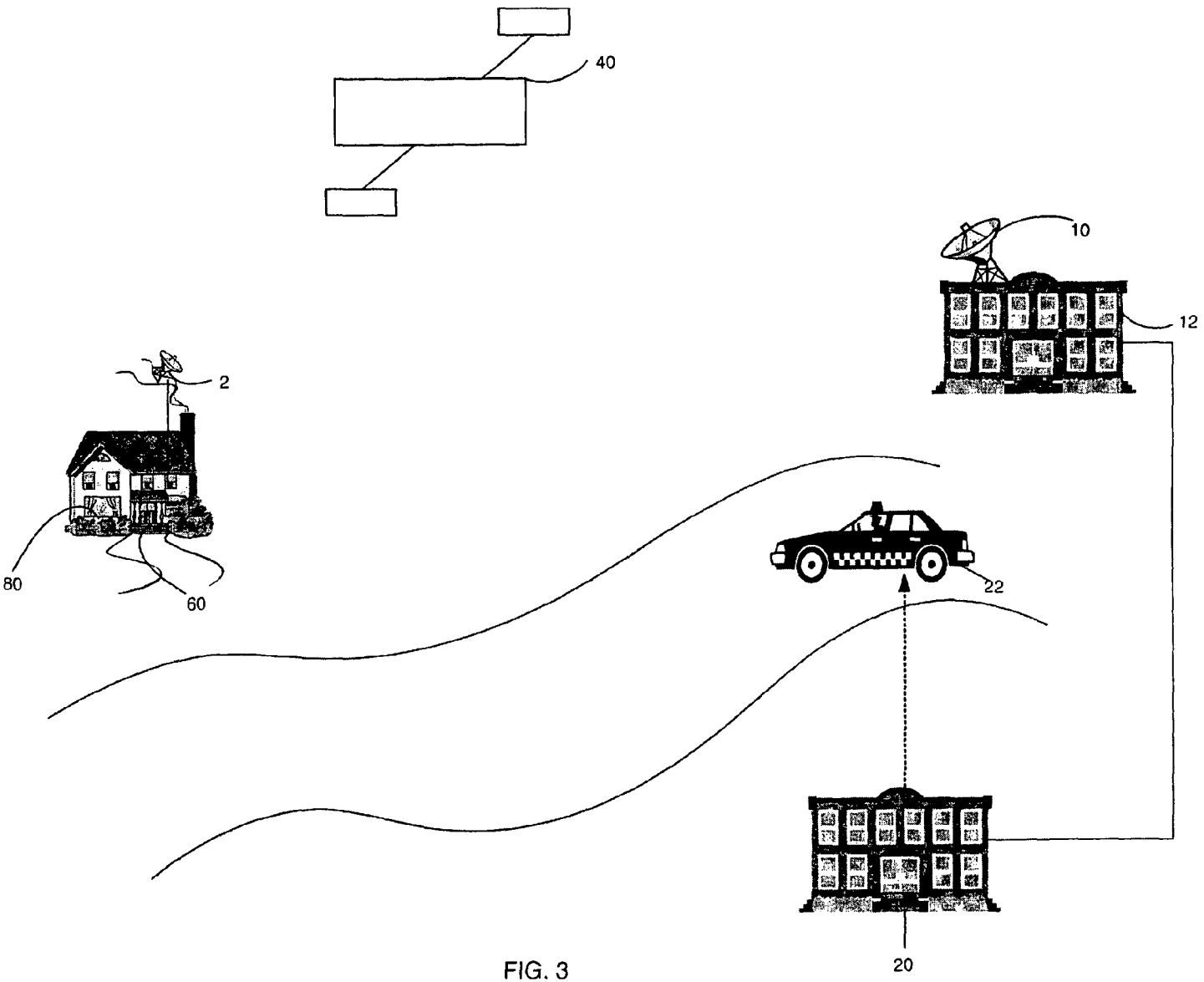
FIG. 3 is a schematic representation showing the positioning of a security system, satellite and processing center, according to an embodiment of the present invention.

A third system is illustrated in further detail in FIG. 3. As shown in FIG. 3, the system involves a subscriber antenna 2 for transmitting and/or receiving satellite signals. The subscriber antenna 2 is located at a subscriber location and supported by a support structure 4. According to an implementation of the present invention, provider-to-subscriber satellite uplink signals are transmitted by the provider antenna 10 from the provider location to a satellite 40. The signals may be modified or terminated at the subscriber location in response to a predetermined event, such as detection of an intruder by detecting means 60, 80. A subscriber antenna 2 located at a subscriber location is positioned to receive the provider-to-subscriber satellite downlink signals. Disabling means 62, operatively associated with said detecting means, may prevent the subscriber antenna 2 from receiving the provider-to-subscriber satellite downlink signals, or alternatively may cause the subscriber antenna to receive the provider-to-subscriber satellite downlink signals in a modified form. The disabling or modification of the provider-to-subscriber satellite downlink signals activates a response at the processing center 12.

Referring still to FIG. 3, the provider antenna 10 located at a provider location is operatively associated with a processing center 12. The processing center 12 receives and processes the subscriber-to-provider satellite downlink signals to produce an appropriate pre-designated response, such as notifying a local law enforcement agency to dispatch a patrol unit 22, for example, without limitation. Optionally, the processing center 12 comprises a feed, a low-noise amplifier and block converter (LNB), where the signals are amplified and then directed to a processor for demodulation and other processing prior to being directed to an output device for review by a human monitoring said output device or an automated response system, or combination thereof. This implementation may be used as a standalone system. Optionally, the system in accordance with this implementation is hard wired or wirelessly operatively associated with local response means either directly or indirectly. Preferably, this system is used in conjunction with another system of the present invention, or other security system, primarily as a backup or default system.

Figure 4:
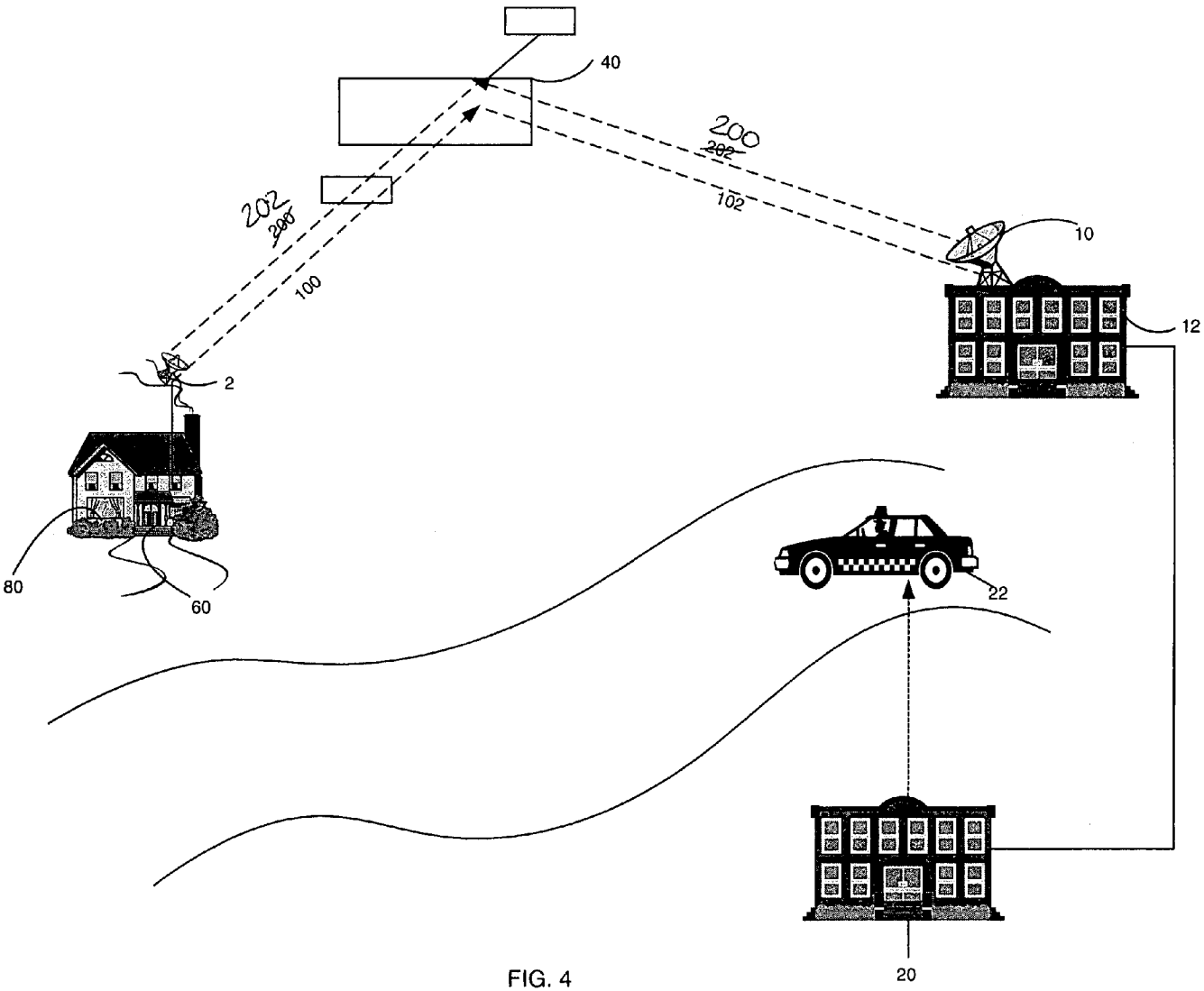
FIG. 4 is a schematic representation showing the positioning of a security system, satellite and processing center, according to an embodiment of the present invention.

A fourth system is illustrated in further detail in FIG. 4. As shown in FIG. 4, the system involves a subscriber antenna 2 for transmitting and/or receiving satellite signals. The subscriber antenna 2 is located at a subscriber location and supported by a support structure 4. According to an implementation of the present invention, subscriber-to-provider return satellite uplink signals 100 are transmitted by the subscriber antenna 2 from the subscriber location in response to a predetermined event, such as detection of an intruder by a detection apparatus 60, to a satellite 40. A provider antenna 10 located at a provider location receives subscriber-to-provider satellite downlink signals 102.

Further, referring still to FIG. 4, provider-to-subscriber satellite uplink signals 200 are transmitted by the provider antenna 10 from the provider location to the satellite 40. The subscriber antenna 2 located at a subscriber location is positioned to receive the provider-to-subscriber satellite downlink signals 202. The provider-to-subscriber satellite signals carry data to activate an alarm/warning system at the subscriber location. As shown in FIG. 4, the provider antenna is transmitting a signal to activate a local response in the form of a patrol unit and a siren alarm at the subscriber location. This signal warns the subscriber location of an impending situation, such as a weather condition or natural or other disaster (e.g., flood, tornado, etc.), without limitation.

Referring still to FIG. 4, the provider antenna 10 located at a provider location is operatively associated with a processing center 12. The processing center 12 receives and processes the subscriber-to-provider satellite downlink signals 102 to produce an appropriate pre-designated response, such as notifying a local law enforcement agency to dispatch a patrol unit 22, for example, without limitation. The processing center 12 comprises a feed, a low-noise amplifier and block converter (LNB), where the signals are amplified and then directed to a processor for demodulation and other processing prior to being directed to an output device for review by a human monitoring said output device or an automated response system, or combination thereof. Further, the processing center 12 receives information regarding a pre-designated condition and transmits the provider-to-subscriber satellite downlink signals 202 to produce an appropriate pre-designated response, such as notifying a local law enforcement agency to dispatch a patrol unit 22 or activating a siren or producing an output, for example, without limitation. The subscriber antenna 2 is optionally operatively associated with a feed, a low-noise amplifier and block converter (LNB), where the signals are amplified and then directed to a processor for demodulation and other processing prior to being directed to an output device for review by a human monitoring or capable of receiving output from said output device or an automated response system, or combination thereof.

In this manner, the present invention can operate as a dual system, such as a dual security/warning system. In other implementations, the present invention can provide a comprehensive two-way communications system that provides broadband data, single- or multi-channel video, and the like, in conjunction with security and warning elements.

Referring again to FIGS. 1-4. the detection apparatus 60 of the present invention comprises a variety of alarm and detection elements, microprocessors and other conventional components of security/alarm/detection systems. The detection apparatus 60 is configured to monitor a predetermined area or each of a plurality of predetermined areas.

Multiple satellites and/or antennas or other relay devices may be incorporated into implementations of the present invention. In this manner, a large number of subscribers may be reached using a satellite system which reuses satellite-allocated frequencies, in accordance with one implementation of the present invention. A person of ordinary skill in the art would understand that it would be possible to vary the arrangements of a plurality of provider and/or relay sites, for example, a primary provider site and plurality of secondary provider site, with one another and in relation to the subscriber locations to attain a desired effect.

The low-noise block converters (LNB) of the present invention may be any conventional LNB. The use of LNBs in radio signal antennas is well known and well within the skill of the art. It would be appreciated by persons of ordinary skill in the art that an LNB could be modified for adaptation to the various embodiments of the present invention using readily available techniques and skills without undue experimentation.

The feeds for terrestrial signals and/or satellite signals may be any conventional feeds. The use of such feeds in radio signals receiving equipment is well known and well within the skill of the art. It would be appreciated by persons of ordinary skill in the art that a feed could be modified for adaptation to the various embodiments of the present invention using readily available techniques and skills without undue experimentation.

The processor of the present invention may be any conventional processor, including conventional demodulators or other processing devices. The use of a wide variety of processors and demodulators is well known and well within the skill of the art. It would be appreciated by persons of ordinary skill in the art that processors and demodulators could be modified for adaptation to various embodiments of the present invention using readily available techniques and skills, without undue experimentation.

The output device optionally includes or is operatively associated with a communications device or software for providing the subscriber with two-way communications capabilities, such as interactive television, for example, without limitation.

The output device of the present invention may be any conventional output device. For example, the output device of the invention may be a television, a computer, a radio, a video recorder/player, a handheld or portable wireless device, and the like, or any combination thereof, without limitation. The use of such output devices in combination with radio signal receiving equipment is well known and well within the skill of the art. It would be appreciated by persons of ordinary skill in the art that an output device could be modified for adaptation to the various embodiments of the present invention using readily available techniques and skills without undue experimentation.

The input device may be any device which allows the subscriber to input data to the receiving apparatus or the transmitting apparatus. For example, the input device may be a channel selector, a computer/keyboard, a remote control device, a set top box, or any combination thereof, without limitation. The input device may include, comprise or be operatively associated with a microprocessor and/or a software module. It would be appreciated by persons of ordinary skill in the art that an input device could be modified for adaptation to the various embodiments of the present invention using readily available techniques and skills without undue experimentation.

The transmitting apparatus of the present invention may be any conventional apparatus for directing and/or processing inputs, including subscriber inputs, preprogrammed responses to received signals or the like, without limitation, for transmission by the subscriber antenna 2 from the subscriber location. The transmitting apparatus may be operatively associated with the receiving apparatus. Alternatively, the transmitting apparatus may include the receiving apparatus, comprise the receiving apparatus or be entirely independent of the receiving apparatus. It would be appreciated by persons of ordinary skill in the art that a transmitting apparatus could be modified for adaptation to the various embodiments of the present invention using readily available techniques and skills without undue experimentation.

Various receiving and/or transmitting antennas may be incorporated into the systems and methods of the present invention. The present invention contemplates having a single antenna at a subscriber location or provider location capable of receiving signals and/or transmitting signals. Also contemplated by the present invention is the use of separate antennas at the provider location and/or subscriber location for receiving and transmitting satellite signals. Accordingly, each antenna at each provider location and each subscriber location is independently a transmitting antenna, a receiving antenna or both.

For example, the subscriber antenna may be a circular wave guide antenna, feed-horn antenna, flat plate antenna, and/or slot antenna, without limitation. The subscriber antenna is preferably a parabolic reflector with an offset feed to reduce sidelobes and increase directivity in the desired direction. The directional antenna, at the provider location may be any conventional directional antenna. Directional antennas are well known and well within the skill of the art. It would be well within the skill of the art to select and incorporate a directional antenna appropriate for implementing each of the embodiments of the present invention, based upon the guidance provided herein.

Preferably, the directional antenna at the provider location is a high-gain sector antenna. More preferably, the directional antenna is a sectional horn having low sidelobes. Even more preferably, the directional antenna is a high-gain sector antenna. Most preferably, the directional antenna is a high-gain sector antenna designed for low sidelobes in the elevation plane.

The beamwidth (in the azimuthal plane) of the antenna at the provider location is preferably about 120 degrees or less, and more preferably, about 100 degrees. In the vertical plane, the beamwidth of the antenna at the provider site is preferably about 20 degrees or less, and more preferably about 3 degrees.

In accordance with various embodiments and/or implementations of the present invention, it would be understood by persons of ordinary skill in the art that each provider site or subscriber location may have one antenna or a plurality of antennas. Each antenna may be the same or different, in any combination possible. Where one antenna is present at a provider site or a subscriber location, that antenna may both transmit and receive terrestrial signals. Where a plurality of antenna are present at a provider site or subscriber location, one or more of the antennas may transmit terrestrial signals and one or more of the antennas may receive terrestrial signals.

The present system is designed to be capable of co-existing as a secondary service with ubiquitously deployed DBS receivers in the 12.2-12.7 GHz band, according to an implementation of the present invention. The deployment may be national in scope, encompassing urban, suburban and rural areas, with the general design parameters cited herein preferably optimized for each individual site.

In one implementation, the present invention uses methods developed via the FCC NPRM (IB Docket No. 00-248, Dec. 14, 2000), incorporated herein by reference, wherein a "mitigation zone" is defined around an antenna at a provider and/or subscriber within which potentially harmful interference might be received by a DBS antenna. Each DBS receiver within the mitigation zone must then be examined to determine whether harmful interference is actually being received. The FCC proposes a "harmful interference criteria" of 2.86% increase in unavailability for each affected DBS receiver. These parameters establish the interference environment. Generally, line-of-sight conditions will dominate.

In accordance with various embodiments of the present invention, interference is optionally mitigated by utilizing relatively low effective isotropically radiated power (e.i.r.p.) terrestrial transmissions. The e.i.r.p. will generally be set at about the minimum value consistent with the service rules and with the goal of achieving availability of 99.7% at the maximum range, taking rain climatic zones into account. Accordingly, the margin may be as high as about 7 dB in areas of intense rainfall, and as little as 2 dB in regions of less intense rain. Power control may be used where necessary to control interference. Preferably, the directional terrestrial antenna transmits signals at an e.i.r.p. of no greater than about 15 dBW. More preferably, the directional terrestrial antenna transmits signals at an e.i.r.p. of no greater than about 10 dBW. Most preferably, the directional terrestrial antenna transmits signals at an e.i.r.p. of no greater than about 12.5 dBm.

In accordance with an implementation of the invention, satellite-allocated frequencies may be reused for terrestrial service by using relatively narrow beams with tightly controlled sidelobes, angular discrimination, frequency selection, inference mitigation and/or combinations thereof.

The system of the present invention may be used in conjunction with a terrestrial communication system. Optionally, a directional terrestrial antenna at a provider site is positioned such that the antenna has a main access of radiation pointed generally southward. Further, the directional terrestrial antenna is optionally oriented 120 degrees in the azimuthal plane. In addition, the terrestrial antenna optionally has a linear polarization.

Transmitted signals, in accordance with an implementation of the present invention, will have a total bandwidth of about 500 MHz and will be composed of individual signal bandwidths ranging from about 24 MHz to about 500 MHz.

The subscriber antenna for receiving signals in accordance with the present invention optionally includes various receiving characteristics for interference mitigation. For example, the subscriber antenna for receiving terrestrial signals optionally includes an offset-fed reflector. Preferably, the offset-fed reflector about 45 cm to about 60 cm. Further, the offset-fed reflector is optionally linearly polarized.

Interference to satellite signal receivers from transmissions at satellite-allocated frequencies may be mitigated by utilizing adaptive interference cancellers (or "interference cancellers"). In particular, adaptive interference cancellers comprise an auxiliary receiving antenna pointed at a major source of interference. The receiving system of the canceller incorporates an adaptive filter which continuously adjusts its parameters to minimize the interfering signal in the output of the receiver of the satellite signal. Any conventional interference cancellers are contemplated by various embodiments of the present invention, as would be appreciated by persons of ordinary skill in the art. Based upon the guidance provided herein, persons of ordinary skill in the art would readily appreciate the various ways in which interference cancellers could be utilized implement the present invention.

An advantage of the present invention over other security systems includes the ability to provide, through one service, a security system, national television programming, regional television programming and local television programing, as well as any other video programming and/or data, including broadband data. Thus, the present invention represents a comprehensive communications system. Moreover, the system, apparatus and method of the present invention may be utilized to provide consumers with data transmission services and Internet services, in addition to single-channel or multi-channel video programming, without limitation. Additionally, the present invention enables at least a full 1 GHz of service to be provided to subscribers. This capability provides a number of benefits, including the ability to use lower power levels, so as to interfere less with satellite signals while maintaining high data rates, as well as a comprehensive communication system, without limitation.

Two-way communication may be provided by the system, apparatus and method of the present invention. The two-way communication provided by the present invention allows subscribers to optionally transmit signals to the service provider, in accordance with various implementations of the present invention. For example, in one implementation of the present invention, a satellite uplink frequency is utilized as a return path for terrestrial service, by having the subscriber antenna at a subscriber location transmit terrestrial signals back to a provider site where it would be received on an antenna and processed by a receiving system. As described above, a terrestrial antenna at a provider site would be aligned in the northward direction.

It will be appreciated by persons or ordinary skill in the art that terrestrial reuse of satellite downlink frequencies relies on the fact that the satellite-based transmitters generally transmit signals from south to north, while the terrestrial transmitters generally transmit from north to south. For example, Interference to and from subscribers using a DBS feeder link band for a return path would be extremely unlikely for two reasons: there are only two, or at most a few DBS feeder link stations in the United States, and they are located in areas of sparse population. Consequently, the transmissions from those stations would not interfere with the receivers at the transmitting and receiving site of the terrestrial service provider. Similarly, since all of the antennas of the Northern Hemisphere subscribers'low-power return paths would be pointing north, none of them could interfere with the receiver on board DBS satellite located in the Earth's equatorial plane, even if tuned to the same frequencies. In this manner, various two-way systems may be provided to consumers whereby consumers communicate with the service provider.

It is contemplated that two-way communications services, including television, such as interactive television, and Internet or other data communications service, and the like, without limitation, are optionally provided in accordance with various implementations of the present invention. For example, in one implementation of the invention, a subscriber may request specific programming or data from the provider by requesting the desired programming or data by transmitting signals with the request to the provider. In another implementation of the present invention, for example, the provider, either automatically or by arrangement, receives signals from the subscriber regarding the programming being viewed or data being received to compile information regarding viewership or user-ship for commercial purposes, such as market research. In another implementation of the present invention, for example, the subscriber transmits data to the provider regarding subscribing to the service, extending subscription and/or payment for service. In another implementation, of the present invention, the subscriber is able to engage in transactions by transmitting signals to the provider, for example, without limitation. It would be clear to persons of ordinary skill in the art as to the manner for providing any variations of subscriber interaction in accordance with various embodiments and implementations of the present invention, based upon the guidance provided herein.

In the case of providing Internet service to subscribers in accordance with the present invention, the Internet service is preferably a high-speed broadband service. More preferably, the Internet service is a high-speed broadband service having an information bit rate from about 1.554 MB/s up to about 40 Mb/s per channel. The Internet service and video programming may be combined in any manner, in accordance with various embodiments and implementations of the present invention. For example, the Internet service may be accessed via a television system, without limitation.

The various embodiments of the present invention may further include a portable or wireless communications device, such as a handheld device or a vehicle installed device, without limitation, which contains a transmitter and/or receiver operatively associated with the subscriber location. In this manner, a subscriber may receive signals from and/or transmit signals to the provider, even when no longer at the subscriber location. For example, such a system is optionally used to activate or deactivate a security system. Such a remote device could be carried by an individual or be installed into a vehicle, for example, without limitation. It would be well within the skill of the art to select the proper components to implement such a system in conjunction with the various embodiments of the present invention described above, based upon the guidance provided herein.

The present invention is not intended to be limited to any particular detecting means. Detecting means of the present invention include a variety of conventional elements and components. Any such detecting means is contemplated by the present invention. A person of skill in the art would readily be able to incorporate appropriate and suitable detecting means in implementing the present invention using conventional techniques and materials. Well-known components are not described in detail in order not to unnecessarily obscure the present invention.

Detecting means may include several alarm activation elements such as a smoke detectors, passive infrared elements, door/window element, motion detection elements, sirens, heat sensors, all of which may be wirelessly, electrically, and/or communicatively coupled to a central console controller. Such coupling may be achieved by the use of electromagnetic radiation having a frequency in the radio, infrared, ultrasonic, ultraviolet, or any other desirable range. Moreover, such wireless communicative coupling may be achieved by the selective generation of signals from elements and by the selective generation of signals from consoles.

The detecting means may also include a repeater which is adapted to receive one of the signals from a console and each of the elements and to produce a signal having substantially the same data structure as the received signal. The use of a repeater increases the allowable communication distance between a console and elements and allows for desirable and controlled operation even though many physical obstructions may lie between elements and console. Further, the detecting means may include a remote keypad, transmitter, and an annunciator. Each of the elements and console may be coupled to a source of electrical power, or may each have a portable electric battery, each of the plurality of batteries being uniquely coupled to one of the elements and to console.

According to an implementation of the present invention, a microprocessor is coupled to a conventional switch having a stationary portion mounted upon a door or window frame and a second movable portion mounted upon a door or window and magnetically coupled to a stationary first portion. In this manner, disruption of the coupled magnetic flux between portions causes an alarm notification signal to be generated to the microprocessor. Upon receipt of a signal, the microprocessor generates a signal which causes an electromagnetic signal to emanate from the antenna. In this manner, the console is made aware of a door or window opening.

According to another implementation of the present invention, a central apparatus and a plurality of detector apparatuses are provided. The detector apparatuses may be intrusion/burglar detectors, such as motion detectors and door/windows detectors for detecting opening of a door/window. Other detector apparatuses may be used as well, such as technology sensors like a smoke/fire detectors, a carbon-monoxide detector, a water detector or a gas detector.

The detector apparatus optionally wirelessly transmits an alarm message to the central apparatus upon detecting an alarm condition. Preferably, for the wireless transmissions, RF is used. Advantageously, a remote control is used to operate the system. In this way the user may, for instance, arm or disarm the system. Since the range of the RF transmission is, typically, larger than the protected area, usually the user can arm and disarm the system from outside the protected area. This eliminates the need for the user having to leave the secure area within a short time after arming the system and having to disarm the system within a short period after entering the secure area. Due to the secure learning process, the remote control also functions as a secure key, eliminating the need to insert a physical key into the central apparatus to arm/disarm the system or use other secure methods, such as entering a PIN code. Advantageously, the remote control transmits also via RF. In addition to allowing the user to control the system, the remote control may also be used to transmit an alarm message to the central apparatus on the initiative of the user of the system (e.g., a panic alarm).

It will be appreciated by persons of skill in the art that a number of, possibly different type of, detector means may be combined in one detector apparatus. With respect to the central apparatus, each detector means may act like a separate detector apparatus, with a separate communication identification and separately being trained. By using type information in the alarm messages, advantageously, a combined detector apparatus only needs to have one identification and only needs to be trained once, where the type information allows the central apparatus to raise a type specific alarm.

Various encoding and modulation techniques, such as Frequency Shift Keying (FSK) and Phase Shift Keying (PSK) are generally known for transmitting digital messages using Radio Frequencies (RF). For a simple system, it is advantageous to use a Pulse Width Modulation (PWM) technique. As an example, each bit of the frame is encoded in two periods. During the first period, the pause period, no signal is transmitted. During the second period an RF signal of, for instance 433.92 MHz., is transmitted. The duration of the second period (the width) corresponds to the data bit being transmitted. For example, the first period has a fixed duration of one millisecond and the second period has a duration of 1 millisecond for transmitting a logical '1' and 2.5 milliseconds for transmitting a logical '0'.

To reduce the chance of a message not being received correctly, the transmitting means of the detector apparatus retransmits the same message a number of times. In this way normal, short disturbances of the RF signal can be recovered. In certain situations the signal may be disturbed for a longer period, for instance caused by other products, such as wireless headphones, operating at a similar frequency or by another apparatus of the same security system transmitting at a similar moment. To overcome such disturbances, the message is retransmitted again after a predetermined delay time T1. It will be appreciated that the process of a block of quick retransmissions followed by a delay and a retransmission of the block can be repeated for as long as desired. Particularly for an alarm message, a detector apparatus may repeat this process for as long as an alarm condition exists. In the repetition, T1 is chosen sufficiently long to ensure that most disturbances have ended. Preferably, T1 is chosen longer than two seconds. A delay time of four seconds for Ti provides a good balance between a long delay time in order to overcome temporary disturbances and a short delay time in order to achieve a good response time of the system. Advantageously, T1 is chosen randomly within a predetermined time window of, for instance, two to six seconds. This reduces the chance that the transmission processes of a number of apparatuses of the same system, which started transmitting at a similar moment (for instance triggered by a same event), stay synchronized, causing no message to be received correctly.

It will be appreciated that in addition to the described measures for increasing the reliability of the communication, the receiving means may additionally use thresholds for determining whether the received signal is transmitted by one of the apparatuses of the system or that a potential intruder or another source generates a signal to block transmissions of an alarm message. As an example, if for a prolonged period no pause signal is detected this may be interpreted as a blocking signal being transmitted and result in an alarm being raised.

Since an already trained remote control acts as a safe key and improves the reliability of the system with respect to training new remote controls, preferably the system is supplied to the customer with the included remote controls already being programmed.

The invention now being fully described, it will be apparent to one of ordinary skill in the art that many changes and modifications can be made thereto without departing from the spirit or scope of the invention as set forth herein. The foregoing describes the preferred embodiments of the present invention along with a number of possible alternatives. These embodiments, however, are merely for example and the invention is not restricted thereto. The present invention is therefore not restricted to the embodiments disclosed above, but is defined in the following claims.

What is claimed is:

1. A security system comprising:

detecting means for detecting presence of an intruder in a predetermined area or a plurality of predetermined areas;

communicating means comprising at least a satellite return channel for communicating, via satellite signals from a subscriber location to a processing center, the detection of the presence of the intruder in the predetermined area or in one or more of the plurality of predetermined areas;

wherein the satellite signals encode data alerting the processing center to the presence of said intruder in said predetermined area or said one or more of the plurality of predetermined areas;

receiving means to receive satellite signals from the processing center at the subscriber location; and disabling means operatively to (1) prevent reception of the satellite signals from the processing center at the subscriber location, or (2) modify the satellite signals from the processing center at the subscriber location;

wherein the satellite signals received from the processing center carry data to activate a local alarm/warning system at the subscriber location.

2. The security system of claim 1, wherein the satellite signals are transmitted at a DBS frequency.

3. The security system of claim 1, wherein the satellite signals are transmitted at a FSS frequency.

4. The security system of claim 1, wherein the detecting means comprises a detection apparatus interface.

5. The security system of claim 1, wherein the processing center comprises a provider antenna for transmitting and/or receiving satellite signals.

6. The security system of claim 1, wherein the predetermined area or plurality of predetermined areas is operatively associated with a subscriber antenna at the subscriber location.

7. The security system of claim 1, wherein the detection of the intruder activates the transmission of satellite signals.

8. The security system of claim 1, wherein the detection of the intruder interrupts the transmission of satellite signals.

9. The security system of claim 1, wherein the detection of the intruder alters the frequency of the satellite signals.

10. The security system of claim 1, wherein the frequency of the satellite signals corresponds to a predetermined security condition.

11. The security system of claim 1, further comprising selection means for selecting an active or inactive mode for the security system.

12. The security system of claim 1, further comprising processing means at the processing center for processing satellite signals encoding data alerting said processing center to the presence of the intruder in the predetermined area or plurality of predetermined areas.

13. The security system of claim 1, further comprising means for providing local response to detection of the intruder.

14. A security system comprising:

detecting means at a subscriber location for detecting the presence of an intruder in a predetermined area or a plurality of predetermined areas;

communicating means comprising at least a satellite return channel for communicating, via satellite signals from a subscriber location to a processing center, the detection of the presence of the intruder in the predetermined area or in one or more of the plurality of predetermined areas;

processing means at the processing center for receiving and processing the satellite signals;

wherein the satellite signals encode data alerting the processing center to the presence of said intruder in said predetermined area or in the one or more of the plurality of predetermined areas;

receiving means to receive satellite signals from the processing center at the subscriber location; and disabling means operatively to (1) prevent reception of the satellite signals from the processing center at the subscriber location, or (2) modify the satellite signals from the processing center at the subscriber location;

wherein the satellite signals received from the processing center carry data to activate a local alarm/warning system at the subscriber location.

15. The security system of claim 14, wherein the satellite signals are transmitted at a DBS frequency.

16. The security system of claim 14, wherein the satellite signals are transmitted at a FSS frequency.

17. The security system of claim 14, wherein the detecting means comprises a detection apparatus interface.

18. The security system of claim 14, wherein the processing center comprises a provider antenna for transmitting and/or receiving satellite signals.

19. The security system of claim 14, wherein the predetermined area or plurality of predetermined areas is operatively associated with a subscriber antenna at a subscriber location.

20. The security system of claim 14, wherein the detection of the intruder activates the transmission of satellite signals.

21. The security system of claim 14, wherein the detection of the intruder interrupts the transmission of satellite signals.

22. The security system of claim 14, wherein the detection of the intruder alters the frequency of the satellite signals.

23. The security system of claim 14, wherein the frequency of the satellite signals corresponds to a predetermined security condition.

24. The security system of claim 14, further comprising selection means for selecting an active or inactive mode for the security system.

25. The security system of claim 14, further comprising processing means at the processing center for processing satellite signals encoding data alerting said processing center to the presence of the intruder in the predetermined area or plurality of predetermined areas.

26. The security system of claim 14, further comprising means for providing local response to detection of the intruder.

27. A security system comprising:

communicating means comprising at least a satellite return channel for communicating, via satellite signals from a subscriber location to a processing center, the detection of the presence of an intruder in a predetermined area or in a plurality of predetermined areas;

detecting interface means for operatively associating the communicating means with detecting means, said detecting means being able to detect the presence of an intruder in the predetermined area or in one or more of the plurality of predetermined areas;

wherein the satellite signals encode data alerting the processing center to the presence of said intruder in said predetermined area or said one or more of the plurality of predetermined areas;

receiving means to receive satellite signals from the processing center at the subscriber location; and disabling means operatively to (1) prevent reception of the satellite signals from the processing center at the subscriber location, or (2) modify the satellite signals from the processing center at the subscriber location;

wherein the satellite signals received from the processing center carry data to activate a local alarm/warning system at the subscriber location.

28. The security system of claim 27, wherein the satellite signals are transmitted at a DBS frequency.

29. The security system of claim 27, wherein the satellite signals are transmitted at a FSS frequency.

30. The security system of claim 27, wherein the detecting means comprises a detection apparatus interface.

31. The security system of claim 27, wherein the processing center comprises a provider antenna for transmitting and/or receiving satellite signals.

32. The security system of claim 27, wherein the predetermined area or plurality of predetermined areas is operatively associated with a subscriber antenna at the subscriber location.

33. A security system comprising:

a subscriber antenna at a subscriber location comprising at least a satellite return channel for communicating, via satellite signals to a processing center, the detection of the presence of an intruder in a predetermined area or in a plurality of predetermined areas;

disabling means operatively to (1) prevent reception of the satellite signals from the processing center at the subscriber location, or (2) modify the satellite signals from the processing center;

detection interface apparatus capable of operatively associating with means for detecting the presence of an intruder in the predetermined area or in one or more of the plurality of predetermined areas;

wherein the satellite signals encode data alerting the processing center to the presence of said intruder in said predetermined area or in the one or more of the plurality of predetermined areas; and wherein satellite signals received at the subscriber antenna from the processing center carry data to activate a local alarm/warning system at the subscriber location.

34. The security system of claim 33, further comprising a provider antenna at a provider location for communicating via satellite signals to the subscriber antenna.

35. A method of communicating the presence of an intruder in a predetermined area via satellite comprising:

detecting the presence of an intruder in a predetermined area or a plurality of predetermined areas;

communicating via satellite signals in at least a satellite return channel, from a subscriber location to a processing center, the detection of the presence of the intruder in the predetermined area or in one or more of the plurality of predetermined areas;

wherein the satellite signals encode data alerting the processing center to the presence of said intruder in said predetermined area or said one or more of the plurality of predetermined areas; and receiving satellite signals from the processing center at the subscriber location, wherein receiving satellite signals comprises (1) preventing reception of the satellite signals from the processing center at the subscriber location, or (2) modifying the satellite signals from the processing center;

wherein the satellite signals received from the processing center carry data to activate a local alarm/warning system at the subscriber location.

36. A method of communicating the presence of an intruder in a predetermined area via satellite comprising:

detecting at a subscriber location the presence of an intruder in a predetermined area or a plurality of predetermined areas;

communicating via satellite signals in at least a satellite return channel, from the subscriber location to a processing center, the detection of the presence of the intruder in the predetermined area or in one or more of the plurality of predetermined areas;

receiving and processing at the processing center the satellite signals to produce a local response at the subscriber location, wherein the local response comprises activating a local alarm/warning system at the subscriber location; and activating a response at the processing center based at least in part on (1) disabling the local response at the subscriber location, or (2) modifying the local response at the subscriber location;

wherein the satellite signals encode data alerting the processing center to the presence of said intruder in said predetermined area or in the one or more of the plurality of predetermined areas.

* * * * *

UNITED STATES PATENT AND TRADEMARK OFFICE

CERTIFICATE OF CORRECTION

PATENT NO. : 7,589,626 B2
APPLICATION NO. : 10/667330
DATED : September 15, 2009
INVENTOR(S) : John Hane It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 41 days.

Signed and Sealed this

Twenty-first Day of September, 2010

David J. Kappos

David J. Kappos
*Director of the United States Patent and Trademark Office*